US008882338B2

(12) United States Patent
Mertenat

(10) Patent No.: US 8,882,338 B2
(45) Date of Patent: Nov. 11, 2014

(54) CHRONOGRAPH MECHANISM WITH A COLUMN WHEEL AND TIMEPIECE MOVEMENT INCLUDING THE SAME

(71) Applicant: ETA SA Manufacture Horlogere Suisse, Grenchen (CH)

(72) Inventor: Olivier Mertenat, Solothurn (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 137 days.

(21) Appl. No.: 13/693,781

(22) Filed: Dec. 4, 2012

(65) Prior Publication Data

US 2013/0148476 A1 Jun. 13, 2013

(30) Foreign Application Priority Data

Dec. 8, 2011 (EP) ..... 11192669

(51) Int. Cl.
*G04F 7/00* (2006.01)
*G04F 7/08* (2006.01)

(52) U.S. Cl.
CPC ..... *G04F 7/0842* (2013.01); *G04F 7/0847* (2013.01); *G04F 7/0814* (2013.01)
USPC ..... 368/103; 368/319

(58) Field of Classification Search
USPC ..... 368/101–106, 110, 112–113, 319
See application file for complete search history.

(56) References Cited

U.S. PATENT DOCUMENTS

| | | | | |
|---|---|---|---|---|
| 7,570,545 | B2 * | 8/2009 | Journe | 368/108 |
| 7,918,602 | B2 * | 4/2011 | Wyssbrod | 368/106 |
| 8,434,934 | B2 * | 5/2013 | Wyssbrod | 368/106 |
| 8,529,121 | B2 * | 9/2013 | Mertenat | 368/101 |
| 2004/0246820 | A1 | 12/2004 | Girardin | |
| 2005/0174888 | A1 | 8/2005 | Forsey et al. | |
| 2008/0310257 | A1 | 12/2008 | Perret et al. | |
| 2011/0002198 | A1 | 1/2011 | Wyssbrod | |

FOREIGN PATENT DOCUMENTS

| | | | |
|---|---|---|---|
| EP | 0 871 095 | A1 | 10/1998 |
| EP | 1 296 205 | A1 | 3/2003 |
| EP | 1 791 043 | A1 | 5/2007 |
| EP | 2 073 077 | A1 | 6/2009 |
| WO | WO 03/040835 | A2 | 5/2003 |

OTHER PUBLICATIONS

European Search Report issued May 22, 2012 in corresponding European Application No. 11 19 2669 filed on Dec. 8, 2011 (with an English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The pusher device of the chronograph mechanism includes a pivoting control part (56) mounted on a first pivot (55) and carrying a click (52) and an intermediate lever (58) mounted on a second pivot (59). The intermediate lever is arranged to be actuated by the push button and includes a distal portion arranged to actuate the pivoting control part (56). The first pivot (55) and the second pivot (59) are arranged at the periphery of the movement on both sides of the push button (67, 69) and the pivoting control part and the intermediate lever extend from their respective pivot against each other. The click (52) is arranged to push in front of it one tooth of the toothing (42) of the column wheel (40) when the push button is actuated, then to return by sliding over the tip of a tooth.

8 Claims, 9 Drawing Sheets

CHRONOGRAPH MECHANISM WITH A COLUMN WHEEL AND TIMEPIECE MOVEMENT INCLUDING THE SAME

This application claims priority from European Patent Application No. 11192669.7 filed Dec. 8, 2011, the entire disclosure of which is incorporated herein by reference.

FIELD OF THE INVENTION

The present invention concerns a timepiece movement including a three stroke chronograph mechanism arranged to control a chronograph hand and at least one counter hand for starting, stopping and quickly returning the hands to their starting point, on demand, by successive applications of pressure on the same push-button. The present invention more particularly concerns a timepiece movement of this type comprising a column wheel and in which the successive applications of pressure on the push button have the effect of gradually incrementing the angular position of the column wheel.

PRIOR ART

Timepiece movements satisfying the above definition are already known. Patent document WO 03/040835 in particular, discloses a watch movement provided with a chronograph which conforms to the preamble of the annexed claim 1. FIGS. 1 and 2 annexed hereto reproduce FIGS. 3 and 8 of this prior art document. These Figures are views from the back cover side of this prior art timepiece movement. FIG. 1 shows the movement with the chronograph mechanism in the rest position, and FIG. 2 is a similar view showing the reset of the chronograph mechanism.

FIGS. 1 and 2 show a pivoting control part 1 which is pivotally mounted about a post screwed into the barrel-bar (the post and barrel-bar are not shown in the Figures, but the pivot axis is indicated by the sign "+"). One end 1*b* of the pivoting part is intended to be connected to a single push button (not shown). The other end of the pivoting control part ends in a click 2 in the form of a hook, which is arranged to cooperate with a ratchet toothing 4*a* of the column wheel 4. A first spring (not shown) is provided for returning the pivoting control part 1 to the rest position shown in FIG. 1. A second spring (not shown) is provided for constantly returning click 2 against ratchet toothing 4*a*. Finally, a jumper spring 3 is also meshed with the ratchet toothing of the column wheel.

The operation of the pusher mechanism provided for manually actuating column wheel 4 will now be described. As already stated, the end 1*b* of pivoting part 1 is connected to the single push button. When a user presses the push button, he pushes the end 1*b* of the pivoting control part towards the centre of the movement. As the pivoting part is pivoted at the centre thereof, the movement of end 1*b* towards the centre of the movement is accompanied by a movement of click 2 in the opposite direction. While moving, the click hooks onto a ratchet tooth 4*a* and drives said tooth towards the exterior of the movement. In doing so, the click causes the column wheel to rotate through one step. When the user releases the pressure on the push button, the pivoting part is returned to the rest position by the first return spring. During this movement, hook-shaped click 2 slides over the sloping portion of a tooth of ratchet 4*a* without rotating the column wheel.

Referring again to FIGS. 1 and 2, it can be seen that pivoting control part 1 takes up a considerable amount of space on the periphery of the movement. WO 03/040835 explains that the shape of the chronograph mechanism shown allows it to be associated with a non-circular timepiece movement. In order to make a round watch which integrates this type of chronograph mechanism, watchmakers often have no choice but to use a watch case that is larger than the movement. They insert an enlarging ring arranged to centre the movement in the round watch case. One drawback of this solution is that it can only be used for making chronograph watches of relatively large dimensions.

BRIEF SUMMARY OF THE INVENTION

It is an object of the present invention to provide an extremely compact pusher mechanism allowing a small push button to be used with a limited travel for controlling the column wheel of the chronograph mechanism of a timepiece movement. The present invention achieves this object by providing a timepiece movement conforming to the annexed claim 1.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

Figure 11:
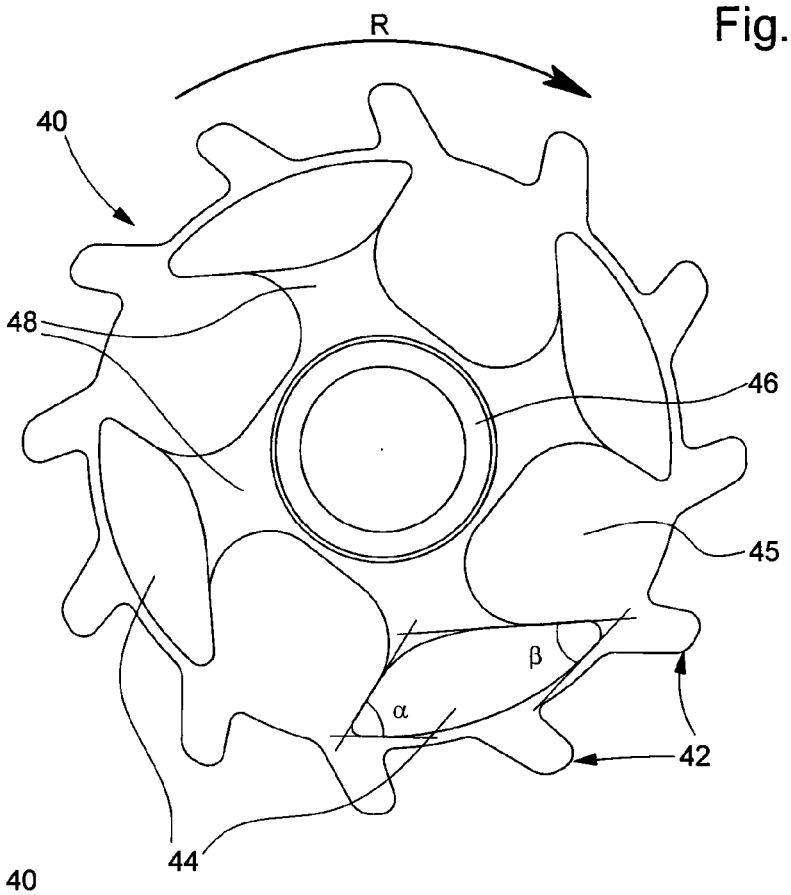
FIG. 11 is a top plan view of the column-wheel of the chronograph mechanism of FIGS. 3 to 8.
Figure 12:
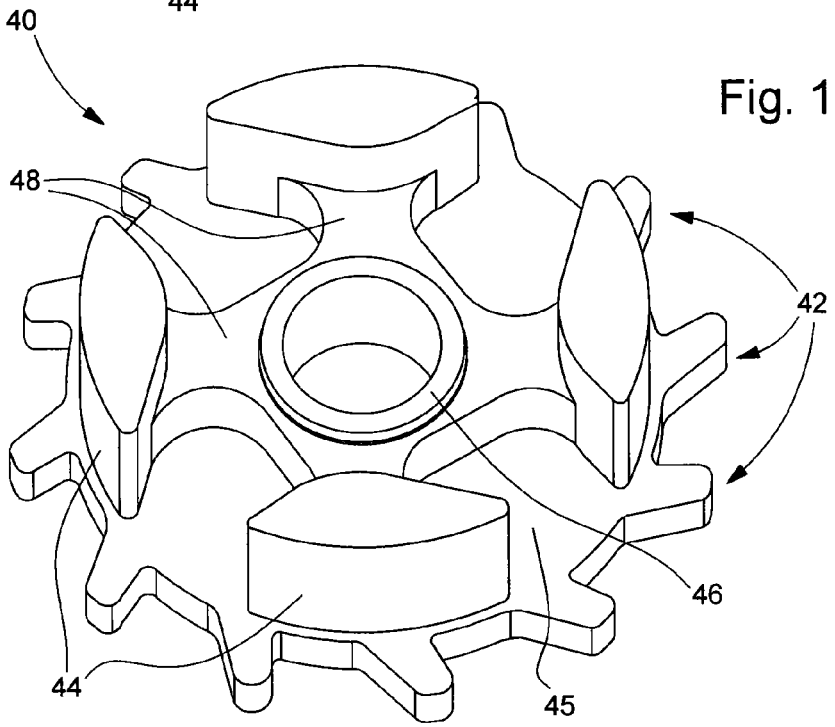
FIG. 12 is a perspective view of the column-wheel of FIG. 11.

Referring first of all to FIGS. 11 and 12, which show a column wheel 40 arranged to be integrated into a timepiece movement according to the present invention, it is seen that the wheel is essentially formed of a ratchet 42 and four columns 44 regularly distributed over the circumference of the ratchet. The column wheel further includes a hub 46 arranged to be pivotally mounted about an axis of the chronograph mechanism (not shown in FIGS. 11 and 12). FIG. 11 also contains an arrow reference R for indicating the direction of rotation of column wheel 40. It will be noted that this is the clockwise direction in this example.

In the example shown, the column wheel further includes four arms 48 which respectively connect the four columns 44 to hub 46 of the wheel. Columns 44, arms 48 and hub 46 thus form a superstructure with rotational symmetry of order 4. Ratchet 42 has 12 teeth separated from each other by 30°. Those skilled in the art will therefore understand that the column-wheel of the present example is a 12/4 stroke column-wheel (3 stroke).

The perspective view of FIG. 12 clearly shows hub 46 and arms 48 which connect the columns to the hub. The presence of the arms and the hub make the structure of the wheel in general and the columns in particular more rigid. It will be clear that a more rigid column wheel allows operation with a particularly high level of accuracy. It may also be observed that the width of the arms at their narrowest point is considerably less than the width of the columns (the width of a column is defined here as the distance separating the leading edge from the trailing edge of said column). According to the invention, the width of arms 48 is less than half the width of columns 44. In the present example, the width of an arm is even around a third of the width of a column. This feature of the invention means spaces 45 can be arranged in the column wheel superstructure. These spaces are necessary to allow the beaks of the various pivoting parts to drop sufficiently far down between the columns.

FIG. 12 also shows that the height of hub 46 and arms 48 is less than that of columns 44. The height of the arms will preferably be between 20% and 60% of the height of the columns. One advantage of this latter feature is that it means that the travel of a lever beak can be extended both upwards and downwards, provided that the lever is mounted sufficiently high to allow the beak to pass above arms 48 of the column wheel. Preferably, the column wheel is made entirely on a lathe. Uninterrupted fabrication on a lathe gives the part remarkable precision.

FIG. 11 clearly shows the profile of columns 40. It may be observed that the profile of the columns generally corresponds to a warped ellipsis, or perhaps more precisely to the profile of an aeroplane wing. The front side of the columns (with reference to the direction of rotation of the column wheel) will thus be designated the "leading edge", and the back edge will be designated the "trailing edge". The columns also have an external face (turned towards the exterior of the column wheel) and an internal face (turned towards hub 46). The external face and internal face meet at the leading edge and the trailing edge. It may be observed that as regards the external face, the profile of the columns forms a circular arc substantially concentric to the column wheel. While on the internal face, the profile of the columns has a larger radius of curvature in the area of the trailing edge than in the area of the leading edge (as is the case with a conventional aeroplane wing).

In FIG. 11, the angle made by the internal face with the external face of a column in the leading edge area is designated "α", and the angle made by the internal face with the external face of a column in the trailing edge area is designated "β". FIG. 11 also shows that the two angles α and β are in reality very rounded. The fact that angle α is very rounded has the advantage of facilitating the progression of the beak of the lever cooperating with the column when the chronograph is operating. As regards angle β, the fact that the angle is rounded does not really have a technical effect and in a variant angle β could be sharp. In the example illustrated, the value of angles α and β is respectively 58 degrees and 31 degrees. According to various embodiments, angle α may vary, but it is preferably comprised between 55 and 65 degrees. Angle β depends on the number of columns comprised in the column wheel, and it will preferably be smaller when the columns are more numerous. However, angle β will preferably be comprised between 25 and 35 degrees.

Finally, the width of a column 44 naturally depends on the number of columns comprised in column wheel 40. However, according to the invention, the columns of the column wheel are wider than the openings arranged between the columns.

FIGS. 3 to 8 are views from the back cover side of a timepiece movement according to a particular embodiment of the invention. The timepiece movement shown is arranged to be integrated in a wristwatch. In these conditions, the crown-pusher which is shown at the top of the Figures would in fact be at three o'clock if one were looking at the dial side of a wristwatch containing the movement. It will thus be clear that, since FIGS. 3 to 8 are views from the back cover side, the "midday" position of the watch is on the right side of the Figures, and the hour circle extends in the anti-clockwise direction in the Figures.

FIGS. 3 to 8 show the same chronograph mechanism at various phases of a complete operating cycle. In addition to the column wheel 40 described above, the chronograph mechanism shown includes a chronograph wheel 1, a pivoting coupling part 4 with a beak arranged to cooperate with the column wheel, an oscillating pinion 2 pivoting on a coupling lever 3 and two springs (respectively referenced 5*a* and 5*b*). The coupling lever is arranged to pivot in one direction or the other so as to cause the toothing of oscillating pinion 2 to alternately engage with or be released from the toothing of chronograph wheel 1. Coupling lever 3 pivots in order to stop and restart the chronograph. Indeed, oscillating pinion 2 is permanently driven by the fourth wheel set of the movement gear train (not shown). In these conditions, when the chronograph wheel is meshed with pinion 2, it is driven, and when the oscillating pinion is released from the toothing thereof, the chronograph wheel is uncoupled.

Figure 3:
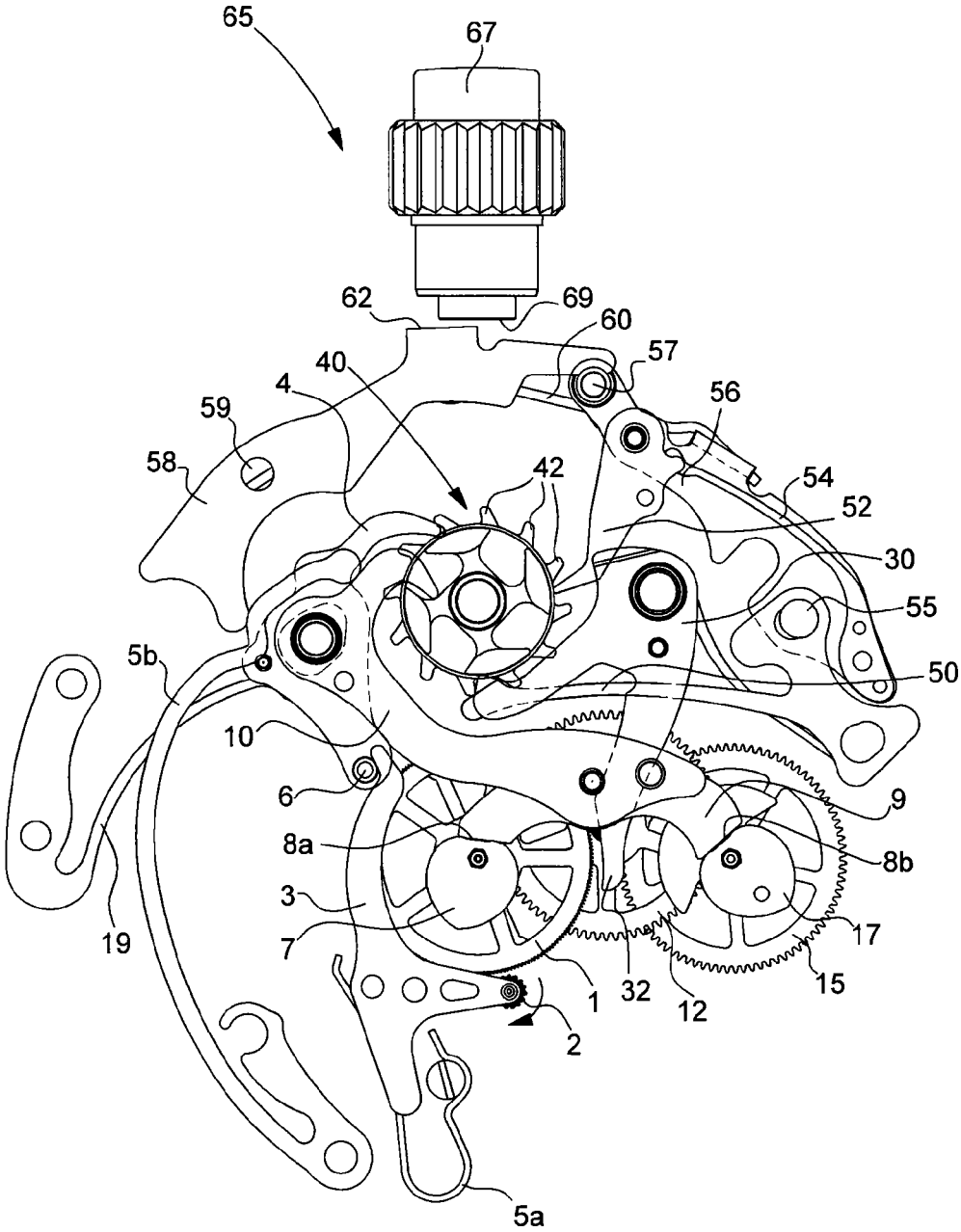
FIG. 3 is a plan view of a chronograph mechanism corresponding to a particular embodiment of the present invention, with the chronograph mechanism reset to zero and ready to start.
Figure 4:
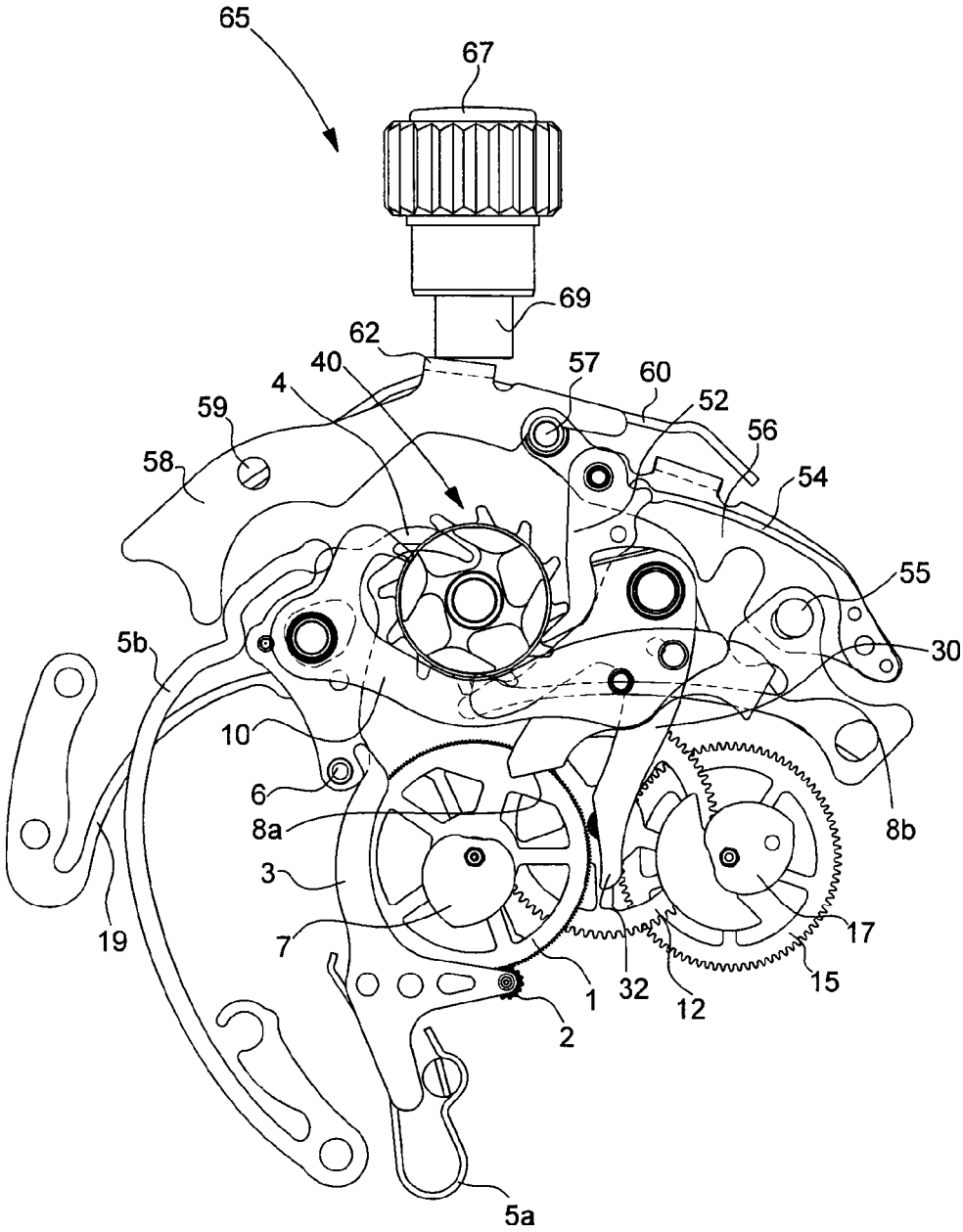
FIG. 4 is a plan view of the chronograph mechanism of FIG. 3 at the moment it is started.
Figure 5:
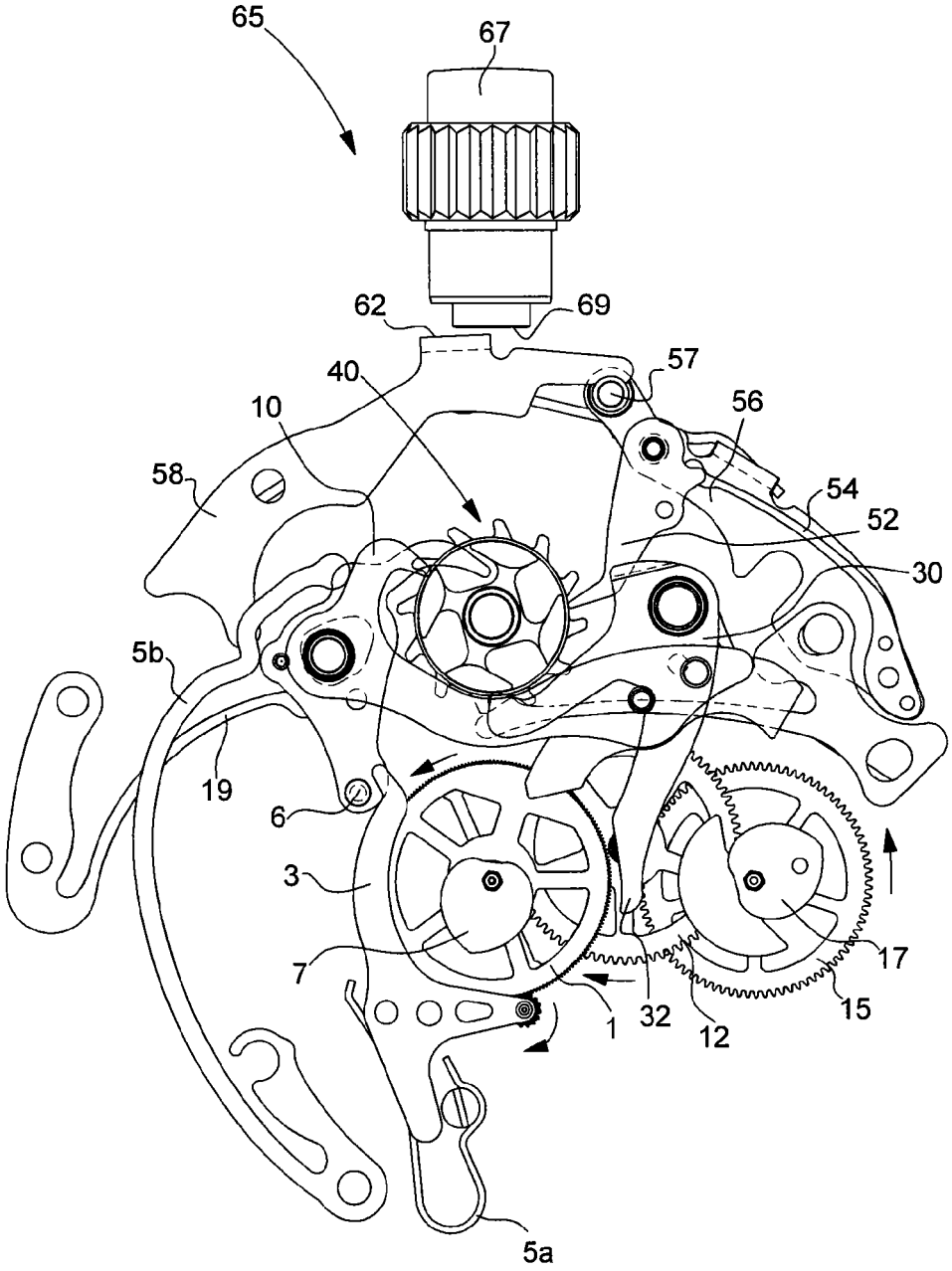
FIG. 5 is a plan view of the chronograph mechanism of FIGS. 3 and 4 during operation.

The purpose of spring 5*a* is to return the coupling lever, and the oscillating pinion that it carries, against the chronograph wheel. Spring 5*b* is arranged to return the beak of the coupling lever against the column wheel. The Figures also show that, at the end opposite the beak, pivoting coupling part 4 carries a pin 6 arranged to cooperate with a corresponding end of coupling lever 3. It can be seen first of all that when the beak of pivoting part 4 is lowered between two columns, as shown in FIGS. 4 and 5 in particular, the pin 6 is moved away from the coupling lever. In these conditions, there is nothing to prevent spring 5*a* meshing oscillating pinion 2 with the toothing of chronograph wheel 1. Conversely, when the beak of the pivoting coupling part is raised by a column of the column wheel, as shown in FIG. 3 in particular, pin 6 forces coupling lever 3 to pivot, which has the effect of moving oscillating pinion 2 away from the toothing of the chronograph wheel. It is therefore column wheel 40 which controls the coupling and uncoupling of chronograph wheel 1.

The chronograph mechanism shown further includes a minute counter wheel 15 and an intermediate wheel 12. Counter wheel 15 is driven by chronograph wheel 1 via intermediate wheel 12. It can also be seen that the arbour of the chronograph wheel and that of the minute counter wheel both carry a reset heart piece (respectively referenced 7 and 17). A hammer with two arms is provided for cooperating with the two heart pieces. This hammer is formed of a reset pivoting part 10 and a moveable pein in the shape of a rudder bar 9. The moveable pein is hinged to one end of pivoting part 10 and it has two sloping portions 8*a*, 8*b* which are each arranged to cooperate with one of heart pieces 7, 17. In a known manner, reset pivoting part 10 is arranged to pivot, either in one direction to lower the hammer against the heart pieces, or in the other direction to raise the hammer. A spring 19 is also arranged to return the hammer against the heart pieces 7, 17 in the rest position. Finally, it is also column wheel 40 which controls the tipping of the hammer.

The chronograph mechanism of the present example further includes a brake, formed by a brake lever 30, one of the ends of which carries a shoe 32 arranged to immobilise chronograph wheel 1 by acting on the periphery thereof. In a conventional manner, brake lever 30 is arranged to pivot alternately between a raised position in which shoe 32 is held away from the chronograph wheel and a lowered position in which the shoe blocks the chronograph wheel. A spring (not shown) is also arranged to return shoe 32 against the chronograph wheel in the rest position. Moreover, it is also column wheel 40 which controls the pivoting of brake lever 30.

The chronograph mechanism of the invention further includes a mechanism for controlling the column wheel. This mechanism, which forms the subject of the invention, is a pusher mechanism. In a conventional manner, the pusher mechanism is arranged to gradually increment the angular position of column wheel 40 when a user repeatedly activates the push button 67. Further, column wheel 40 is field by a column wheel jumper spring (referenced 50 in FIGS. 3 and 6) which presses against the ratchet teeth (referenced 42) so as to hold the column wheel in a stable position.

The pusher of crown-pusher 65 is arranged to move axially in the plane of the movement when a user actuates the pusher by pressing button 67 of crown-pusher 65. The pusher therefore changes from a rest position (illustrated in FIG. 3) to an active position (illustrated in FIG. 4). The mechanism which, in the example shown, connects button 67 of crown-pusher 65 to column wheel 40, includes a click 52, a click spring 54, a pivoting control part 56, an intermediate control lever 58 and a control spring 60. As already stated, in the present example, crown-pusher 65 is arranged at the periphery of the movement, at "3 o'clock". The crown-pusher is associated with a winding and time-setting stem (referenced 71 in FIG. 9) which extends towards the centre of the movement. The intermediate lever 58 is mounted on a pivot 59 (hereinafter the "second pivot") which is fixed to the frame at "4 o'clock", close to the periphery of the movement. In this example, the movement is round in shape. The slightly bent shape of lever 58 allows it to extend substantially along the periphery of the movement in the interval between "4 o'clock and 2 o'clock". The intermediate lever carries a tongue 62 at 3 o'clock which is turned towards the crown-pusher. This tongue is bent at an angle of around 90° towards the dial side of the movement. The tongue thus forms a flag which approximately faces the crown-pusher. As seen in more detail below, the push button includes a bearing surface 69 which is arranged to press against the flag so as to actuate the intermediate lever of the control mechanism when the push button is actuated.

Pivoting control part 56 is mounted on a first pivot 55 which is fixed to the frame at 1 o'clock. FIG. 3 shows that the slightly bent shape of pivoting control part 56 enables it to extend substantially along the periphery of the movement into proximity with the crown-pusher. Thus, in short, the pivoting control part 56 and intermediate lever 58 are pivoted on both sides of and at a distance from crown-pusher 65. They extend toward each other from their respective pivot 55, 59, substantially along the periphery of the movement. It can also be seen in the Figures that the free end of pivoting part 56 has a projecting portion formed, in this example, by a staged post 57. The projecting portion is arranged to cooperate with the distal end of intermediate lever 58. More specifically, as illustrated in FIGS. 3 to 9, the distal portion of lever 58 is arranged to abut against staged post 57.

Control spring 60 is arranged to cooperate with the pivoting control part 56 so as to return the free end of said pivoting part towards the periphery of the movement. It will also be clear that because of the presence of post 57, the action of spring 60 also has the effect of returning lever 58 towards the exterior of the movement. Conversely, when a user pivots lever 58 by pressing on pusher 67, the distal end of said lever pushes post 57, thereby pivoting the pivoting control part 56. Comparing FIGS. 3 and 4 for example, it can also be seen that the simultaneous pivoting of intermediate lever 58 and pivoting control part 56 is accompanied by the sliding of post 57 against the distal portion of the intermediate lever. It will be clear that because of this sliding movement, when the pusher mechanism changes from the rest position to the active position, the lever arm between pivot 59 of the intermediate lever and post 57 is shortened.

Figure 10A:
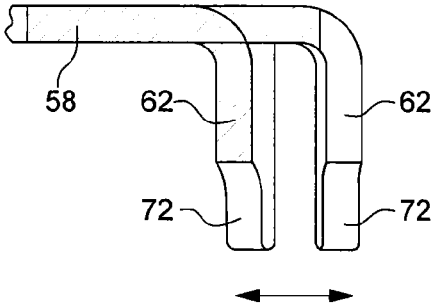
FIGS. 10*a* and 10*b* are views of a flag-shaped tongue forming part of the pusher mechanism.
Figure 10B:
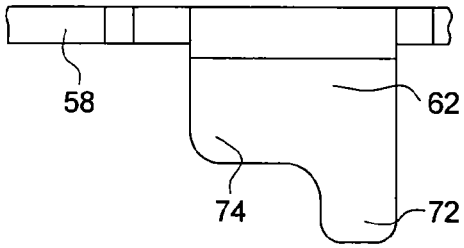

FIGS. 10*a* and 10*b* illustrate flag-shaped tongue 62 carried by intermediate lever 58. FIG. 10*a* shows the superposition of two side views representing two snapshots of the tongue respectively in the rest position and in the active position of the pusher mechanism. FIG. 10*b* is a front view of tongue 62 from the crown-pusher side. It can be seen in particular in this Figure that a recess is arranged in the left portion of the flag. This recess is positioned in the axis of the winding and time-setting stem 71 so as to allow said stem to pass. Moreover, it is seen that the tongue has a narrow distal portion 72 (on the right in FIG. 10*b*) which is arranged to extend over the side of stem 71, on the side of pivot 59 thereof. On the recess side, the tongue forms a shoulder 74. This shoulder occupies the space between stem 71 and the main plane of intermediate lever 58.

Figure 9:
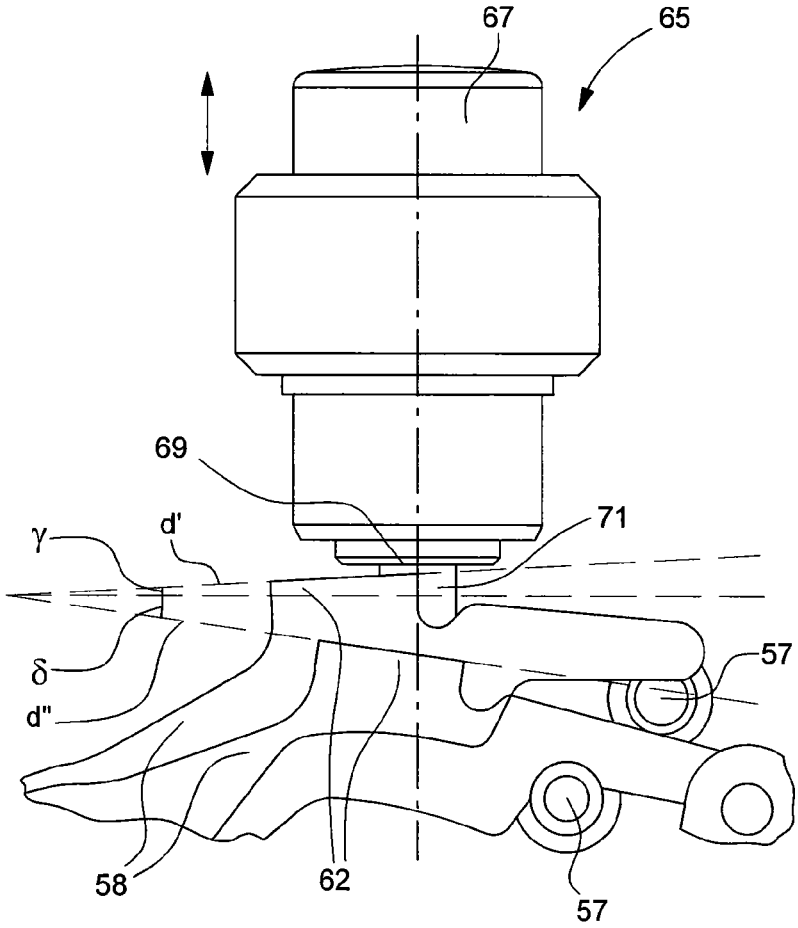
FIG. 9 is a partial, plan view which shows two superposed snapshots. These two snapshots respectively illustrate the rest position and the active position of the pusher mechanism.

Like FIG. 10*a*, FIG. 9 shows the superposition of two snapshots. These two snapshots respectively illustrate the rest position and the active position of intermediate lever 58 and post 57. It will be clear that FIG. 9 is a view of the movement from the bar side, the plane of the drawing being parallel to that of the movement. The flag formed by tongue 62 therefore extends in a plane perpendicular to that of the drawing. The two straight lines d' and d" in the drawing are respectively the outlines of the plane of the flag in the rest position and the active position of the pusher mechanism. It is seen that d' forms an angle $\gamma$ with the plane of bearing surface 69, whereas d" forms an angle $\delta$ with said plane. Angles $\gamma$ and $\delta$ have opposite signs.

FIG. 9 shows that, as already stated, tongue 62 is approximately in the axis of crown-pusher 65. When the pusher is in the rest position, intermediate lever 58 is pivoted towards the exterior of the movement. In this position, the plane of the flag is not exactly parallel to bearing surface 69 of the pusher as demonstrated by the angle $\gamma$ between outline d' and the plane of the bearing surface. In these conditions, when the push button goes from the rest position to the active position, bearing surface 69 starts by pressing against the edge of the tongue close to shoulder 74. From this moment, the pressure of the bearing surface on the tongue has the effect of pivoting intermediate lever 58 and therefore also pivoting the plane of the flag. As a result, the angle between the plane of the flag and the plane of the bearing surface soon changes sign. Simultaneously, the area of contact between the bearing surface and the tongue moves towards the narrow distal portion 72 of the tongue. Referring again to the Figures, it is clear that the lever arm between the second pivot 59 and the distal portion 72 is shorter than the lever arm between pivot 59 and shoulder 74. Thus, when the pusher mechanism changes from the rest position to the active position, the lever arm between pivot 59 of the intermediate lever and the area of contact with bearing surface 69 of the pusher is shortened. This shortening has the advantage of compensating for the simultaneous shortening of the lever arm between pivot 59 and post 57. Thus, the variation in the lever ratio of intermediate lever 58 during the change from the rest position to the active position is at least partially compensated for.

Figure 2:
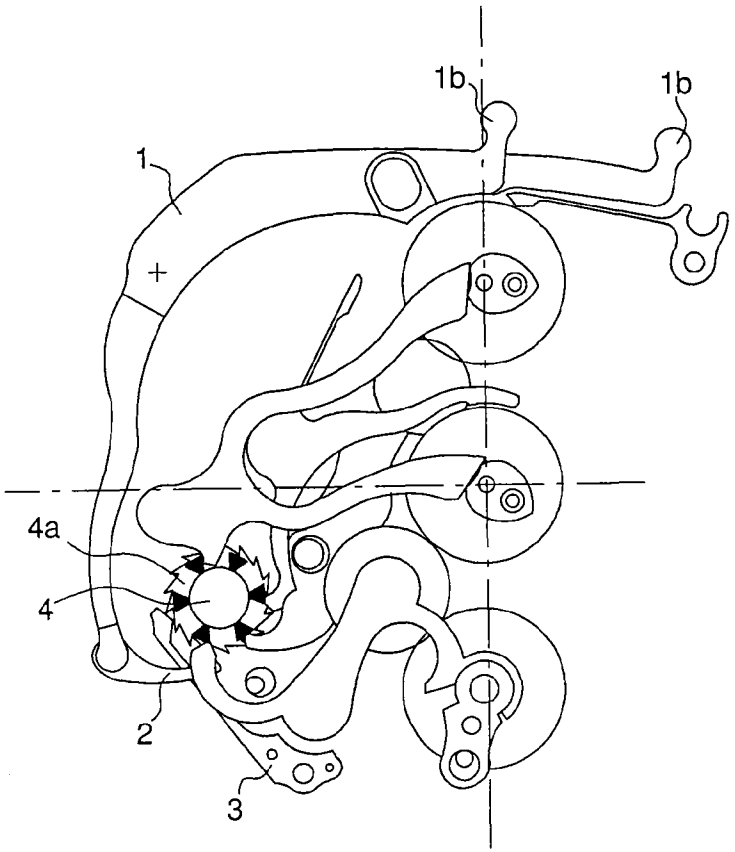
Fig. 2 (Prior Art)
FIG. 2 is a similar view to FIG. 1 of the chronograph mechanism when it is reset to zero.
Figure 1:
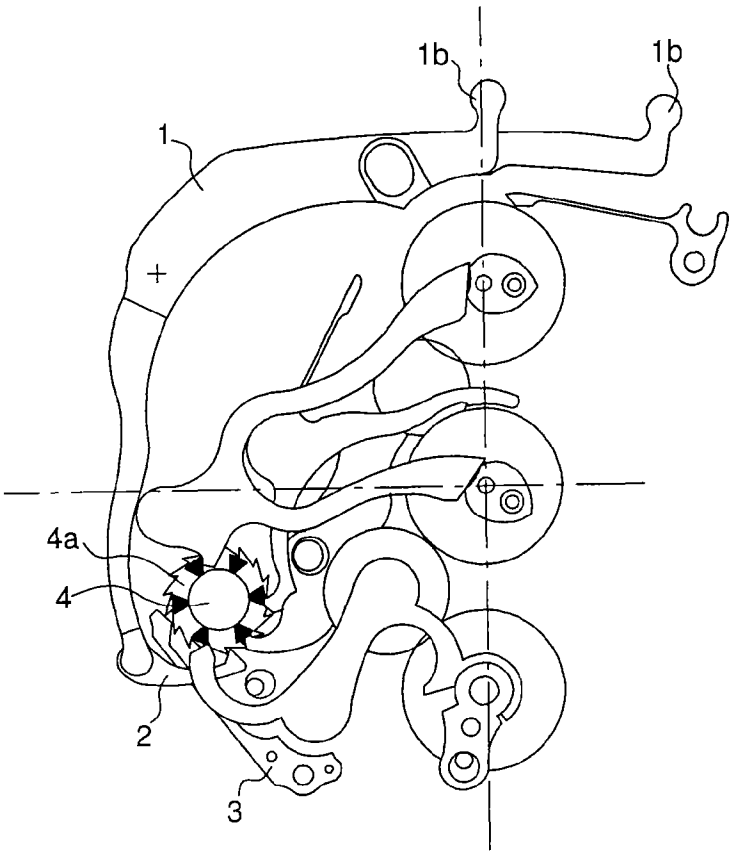
Fig. 1 (Prior Art)
FIG. 1 is a top, plan view of a prior art three-stroke chronograph mechanism in the rest position.

In a known manner, the free end of control lever 56 carries the click (referenced 52) of the pivoting control part. Click 52 pivots freely on the end of the pivoting part and is return against the ratchet toothing 42 of the column wheel by click spring 54. Click 52 is thus arranged to cooperate with ratchet teeth 42 and when, as a result of pressure on the push button, the end of pivoting control part 56 is made to pivot towards the centre of the movement, click 52 accompanies this movement by pushing one ratchet tooth towards the centre of the movement. Thus, in the usual way, each pressure on the pusher causes the column wheel to move forward by the value of one ratchet tooth. Then, as soon as the pressure on the push button is released, control spring 60 returns pivoting part 56 and lever 58 to their rest position. Click 52 also returns, releasing itself from the ratchet by sliding over the sloping portion of a ratchet tooth. The click is thus ready to actuate the next tooth, when pressure is next applied to the push button. It will be clear from the foregoing that, in this example, the pivoting control lever 56 forms a lever of the second kind (in other words "inter-resistant") and that click 52 actuates the column wheel by pushing back ratchet teeth 42. This arrangement differs from that of conventional pusher mechanisms wherein the pivoting control part behaves like a lever of the first kind (in other words "inter-support"), and wherein the click has the shape of a hook which actuates the column wheel by pulling a ratchet tooth towards the exterior of the movement (as illustrated in FIGS. 1 and 2 showing a prior art chronograph mechanism). One advantage of using a lever of the second kind, which carries a click arranged to push the ratchet teeth, is that it reduces the space occupied by the chronograph mechanism.

In a conventional manner, in this example, the push button must be pressed three times for one column to take the place of the preceding one, which corresponds to the three chronograph functions: start, stop and reset. FIG. 3 shows the chronograph mechanism when stopped, after having been reset to zero. All the elements of the chronograph mechanism are stopped with the exception of oscillating pinion 2 which is permanently driven by the gear train of the watch movement (the direction of rotation of the oscillating pinion is indicated by the arrow).

FIG. 4 illustrates the moment that the chronograph mechanism is started. The button 67 of the crown-pusher is pushed in and intermediate lever 58 and pivoting control part 56 have pivoted towards the centre of the movement, driving click 52. This movement of the click moves column wheel 40 forward by 30° in the clockwise direction. The 30° rotation of the column wheel has the effect of raising the beak of reset pivoting part 10, pivoting it to raise the hammer and to release heart pieces 7, 17. Moreover, the rotation of the column wheel also has the effect of dropping the beak of pivoting coupling part 4 into the space between two columns (referenced 44 in FIGS. 9 and 10). As seen above, by allowing the pivoting coupling part to pivot in this way as a result of the action of spring 5, the incrementation of the column wheel also causes the toothing of the oscillating pinion to engage with the toothing of chronograph wheel 1. Finally, the 30° rotation has no effect on the brake, thus the beak remains raised.

FIG. 5 shows the chronograph mechanism in operation. Button 67 of crown-pusher 65 has returned to its rest position, as have intermediate lever 58 and pivoting control part 56. Click 52 has also come back, and is again ready to actuate the next tooth when the push button is actuated again. Chronograph wheel 1, intermediate wheel 12 and minute counter wheel 15 are driven in rotation by oscillating pinion 2 in the direction indicated by the arrows in the Figure.

Figure 6:
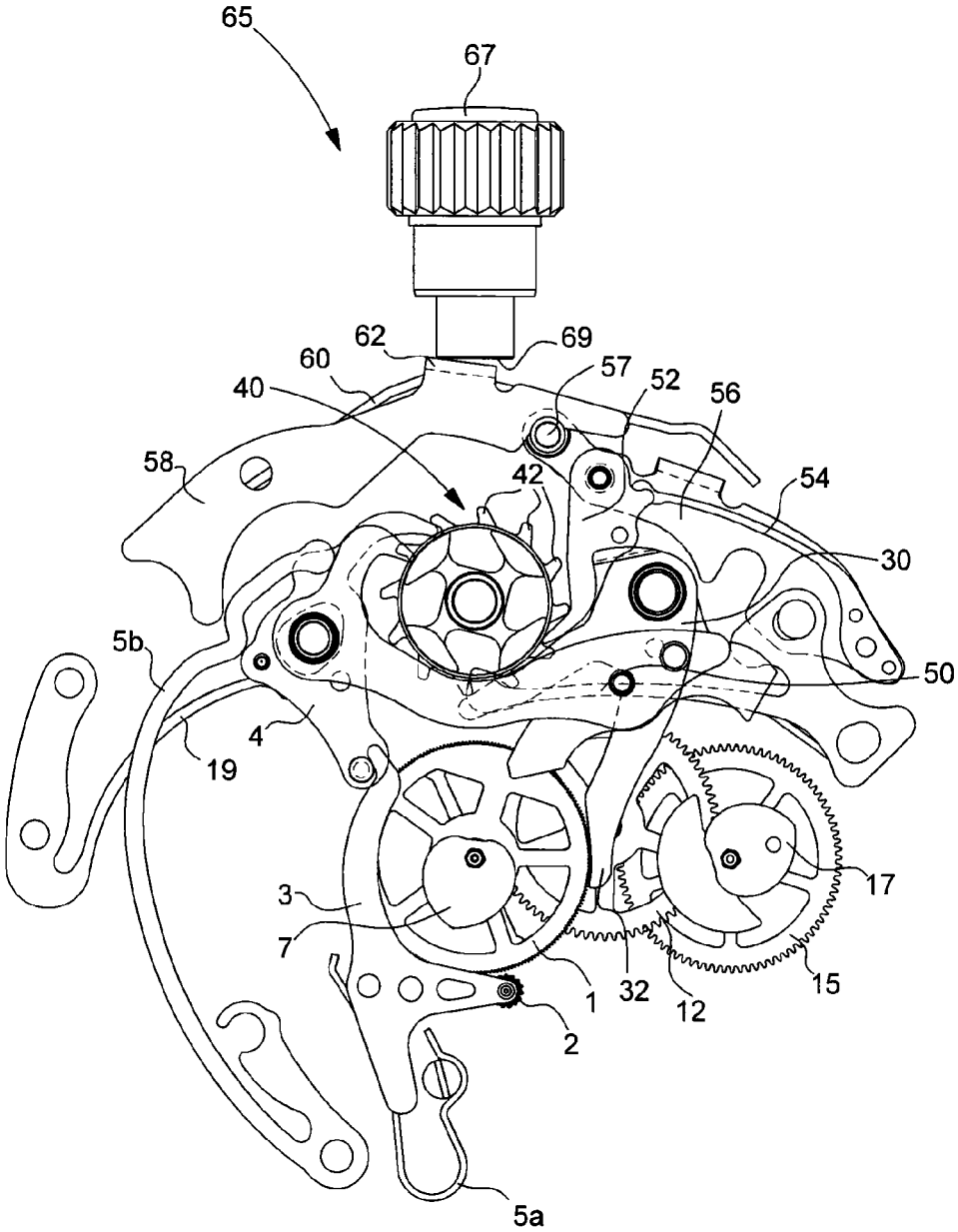
FIG. 6 is a plan view of the chronograph mechanism of FIGS. 3 to 5, at the moment when the mechanism stops.

FIG. 6 illustrates the moment when the chronograph mechanism stops. Following another actuation of the crown-pusher, push button 67 is pushed in and intermediate lever 58 and pivoting control part 56 have again pivoted towards the centre of the movement driving click 52 and rotating the column wheel through 30° again. This new incrementation of the column wheel has the effect, on the one hand, of causing the beak of pivoting coupling part 4 to be raised, causing oscillating pinion 2 to be released from chronograph wheel 1. Moreover, the rotation of the column wheel also has the effect of dropping the beak of brake lever 30 into the space between two columns 44 by pivoting the pivoting part. As seen above, the pivoting of lever 30 lowers shoe 32 against chronograph wheel 1 so that the shoe blocks the chronograph wheel.

Figure 7:
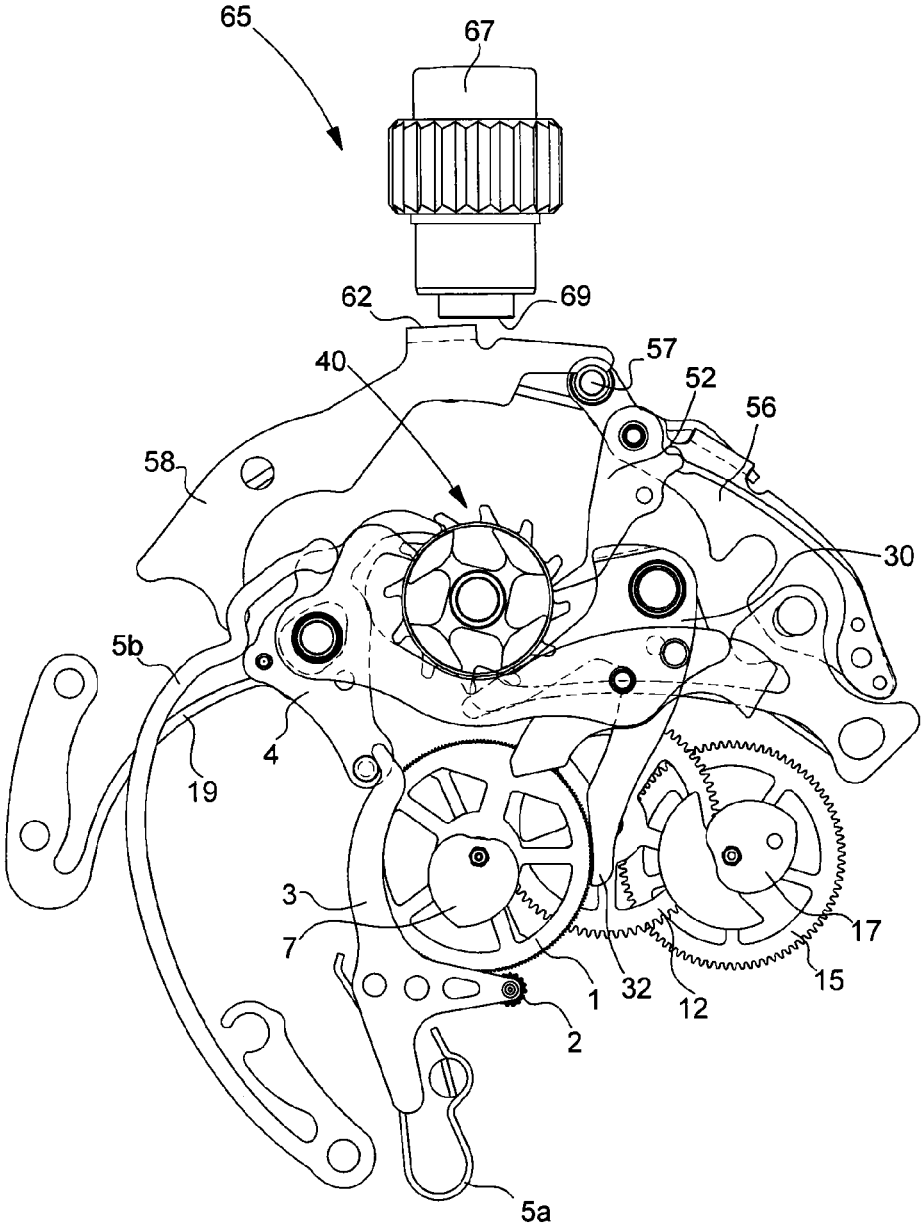
FIG. 7 is a plan view of the chronograph mechanism of FIGS. 3 to 6, when stopped.

FIG. 7 shows the chronograph mechanism stopped. The button of crown-pusher 65 has returned to its rest position, as have intermediate lever 58 and pivoting control part 56. Click 52 has also come back, and is again ready to actuate the next tooth when the push button is actuated again. shoe 32 of brake lever 30 retains chronograph wheel 1 and minute counter wheel 15 in the position in which the chronograph mechanism was stopped, allowing the time which elapsed between the start and stop of the chronograph mechanism to be read.

Figure 8:
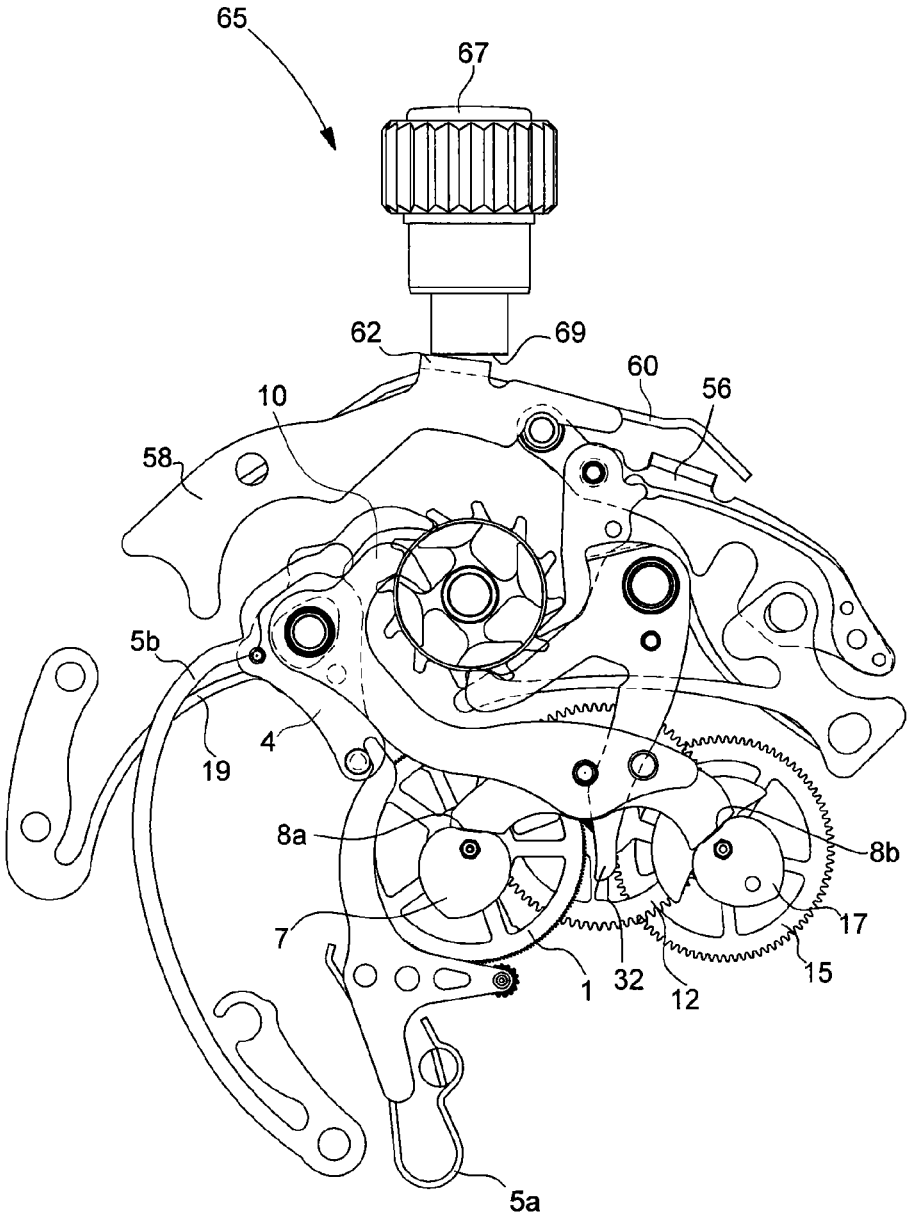
FIG. 8 is a plan view of the chronograph mechanism of FIGS. 3 to 7, at the moment when the mechanism is reset to zero.

FIG. 8 shows the moment that the chronograph mechanism is reset to zero. Following another actuation of the crown-pusher, push button 67 is pushed in and intermediate lever 58 and pivoting control part 56 have again pivoted towards the centre of the movement driving click 52 and incrementing the column wheel through 30° again. This new incrementation of the column wheel has the effect, on the one hand, of raising the beak of brake lever 30, causing shoe 32 to move away from chronograph wheel 1. Moreover, the rotation of the column wheel also has the effect of dropping the beak of reset pivoting part 10 into the space between two columns 44 and thereby pivoting the pivoting part. The effect of the pivoting of the pivoting part is to lower the two sloping portions 8*a* and 8*b* of the hammer respectively against the two heart pieces 7, 17 so as to return chronograph wheel 1 and minute counter wheel 15 to their respective start positions.

Referring again to FIGS. 3 to 8, it will be noted that, if the beak of pivoting coupling part 4 and of reset pivoting part 10 are compared to those shown in FIG. 2, it is immediately evident that the beaks of the chronograph movement according to the present invention can be much more tapered than those of the prior art. One advantage of this feature is that a tapered beak (the point of which forms an angle of less than 40°; and preferably an angle of less than 30°), allows the pivoting parts of the chronograph mechanism of this example to be lowered even into the relatively narrow space formed by the gap between two columns of the column wheel illustrated in FIG. 10 for example. As a corollary, it will also be clear that the use of tapered beaks like those of the pivoting parts of the chronograph mechanism of this example requires wider columns in return to prevent the beaks from lowering ill-advisedly.

What is claims is:

1. A timepiece movement including a chronograph mechanism comprising a column wheel and a pusher device arranged for manually actuating the column wheel, the pusher device comprising a push button axially moveable parallel to the plane of the movement between a rest position and an active position, and comprising a pivoting control part mounted on a first pivot and carrying a click, the click being returned against a toothing of the column wheel wherein the pusher device further includes an intermediate lever mounted on a second pivot and extending substantially along the periphery of the movement, the intermediate lever being arranged to be actuated by the push button, and comprising a distal portion arranged to actuate the pivoting control part, the first pivot and the second pivot being arranged at the periphery of the movement on both sides of the push button, and the pivoting control part and the intermediate lever extending from the respective pivot thereof toward each other, a distal portion of the pivoting control part being arranged to cooperate with the distal portion of the intermediate lever; and wherein the click is arranged to forward one tooth of the toothing of the column wheel when the push button is moved from the rest position into the active position and to be released from the toothing by sliding over the top of one tooth when the push button returns to the rest position from the active position.

2. The timepiece movement according to claim 1, wherein a free end of the pivoting control part, first, has a projecting portion, the distal portion of the intermediate lever being arranged to abut against the projecting portion, and wherein when the push button changes from the rest position to the active position, the projecting portion slides against the distal portion of the intermediate lever towards the pivot, so that the distance between the second pivot and a point of contact between the intermediate lever and the projecting portion is decreased.

3. The timepiece movement according to claim 1, wherein the timepiece movement is round in shape.

4. The timepiece movement according to claim 1, wherein the push button includes a bearing surface perpendicular to the axis of the pusher, and wherein the intermediate lever carries a flag arranged between the second pivot and the distal portion, in the axis of the push button, the flag extending in a substantially perpendicular plane to the plane of the movement, and the bearing surface of the push button being arranged to abut against an area of the flag, so that the bearing surface pushes back the intermediate lever towards the centre of the movement actuating the pivoting control part when the push button is moved from the rest position to the active position.

5. The timepiece movement according to claim 4, wherein the angle formed by the plane of the bearing surface with the outline of the plane of the flag in the plane of the movement, changes sign when the push button changes from the rest position to the active position.

6. The timepiece movement according to claim 5, wherein, when the push button changes from the rest position to the active position and said angle changes sign, the area of the flag against which the bearing surface abuts moves towards the pivot of the intermediate lever so as to increase the lever ratio of the intermediate lever.

7. The timepiece movement according to claim 5, wherein it includes a winding and time setting stem which extends from a crown towards the centre of the movement coaxially with the push button, and wherein the flag has a recess in the axis of the push button to allow the stem to pass, a narrow distal portion of the flag extending between the stem and the pivot, whereas the part of the flag located between the stem and the intermediate lever forms a shoulder.

8. The timepiece movement according to claim 7, wherein, when the push button changes from the rest position to the active position and said angle changes sign, the area of the flag against which the bearing surface abuts, moves from the shoulder to the narrow distal portion so as to increase the lever ratio of the intermediate lever.

* * * * *